US006554665B1

(12) United States Patent
Kaneko

(10) Patent No.: US 6,554,665 B1
(45) Date of Patent: Apr. 29, 2003

(54) EXHAUST SYSTEM FOR WATERCRAFT

(75) Inventor: Yoshiyuki Kaneko, Iwata (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/676,215

(22) Filed: Sep. 28, 2000

(30) Foreign Application Priority Data

Sep. 28, 1999 (JP) ..... 11-274569

(51) Int. Cl.[7] ..... B63H 21/32
(52) U.S. Cl. ..... 440/89
(58) Field of Search ..... 60/310; 440/89

(56) References Cited

U.S. PATENT DOCUMENTS

| | | | | |
|---|---|---|---|---|
| 5,390,621 A | * | 2/1995 | Hattori et al. | 114/270 |
| 5,511,505 A | | 4/1996 | Kobayashi et al. | |
| 5,647,779 A | | 7/1997 | Nanami | |
| 5,954,553 A | | 9/1999 | Ozawa et al. | |
| 6,120,335 A | | 9/2000 | Nakase et al. | |
| 6,261,140 B1 | | 7/2001 | Yoshida et al. | |

OTHER PUBLICATIONS

Model Year 2000 Yamaha GP 1200AY Parts List, p. D7.
Model Year 2000 Yamaha XL1200Y Parts List, p. D5.
Model Year 2000 Yamahs SV1200Y Parts List, p. D4.
Model Year 2000 Yamaha XL700Y Parts List, p. D3.
Model Year 2000 Yamaha XL800Y Parts List, p. D2.
Model Year 1999 Yamaha GP1200X2 Parts List, p. D3.
Model Year 1999 Yamaha SV1200X Parts List, p. D5.
Model Year 1999 Yamaha XA1200X Parts List, p. D6.
Model Year 1998 Yamaha GP1200W Parts List, p. D5.
Model Year 1999 Yamaha WVT700W Parts List, p. C8.
Model Year 1997 Yamaha WVT760V Parts List, p. C11.

* cited by examiner

*Primary Examiner*—Ed Swinehart
(74) *Attorney, Agent, or Firm*—Knobbe, Martens, Olson & Bear, LLP

(57) ABSTRACT

A watercraft includes an exhaust system having a connection pipe communicating exhaust gases from an expansion chamber to a water trap. The water trap is positioned generally toward one side of a center line of the watercraft and is angled relative to the center line. A downstream end of the connection pipe opens into a rearward section of the water trap. An exhaust discharge port opens through an upper portion of a forward section of the water trap. The discharge port is closer to the center line than is the downstream end of the connection pipe. An exhaust discharge conduit extends from the discharge port to an exhaust outlet formed through the watercraft hull on an opposite side of the center line from the water trap. In this arrangement, when the watercraft is rolled onto its side, the water trap will prevent water from invading the watercraft engine.

34 Claims, 6 Drawing Sheets

EXHAUST SYSTEM FOR WATERCRAFT

RELATED APPLICATIONS

This application claims priority to Japanese Application No. Hei 11-274569, filed Sep. 28, 1999.

BACKGROUND OF THE INVENTION

1. Field of the Invention

The present invention relates to a small watercraft, and more particularly to a system for deterring water invasion through the exhaust system of a watercraft.

2. Description of Related Art

Personal watercraft have become very popular in recent years. This type of watercraft is quite sporting in nature and carries a rider and possibly one, two or three passengers. A relatively small hull of the personal watercraft commonly defines a riders'area above an engine compartment. An internal combustion engine frequently powers a jet propulsion unit which propels the watercraft. The engine lies within the engine compartment in front of a tunnel formed on the underside of the watercraft hull. The jet propulsion unit is located within the tunnel and is driven by a drive shaft. The drive shaft usually extends between the engine and the jet propulsion device, through a wall of the hull tunnel.

As is typical with marine propulsion systems, the engine exhaust gases are discharged to the atmosphere either at, below or close to the water level at which the watercraft is operating. Thus, care must be taken to ensure that water cannot enter the engine through the exhaust system. This problem is particularly acute in personal watercraft. Because of their sporting nature and high degree of maneuverability, personal watercraft can be expected to be capsized occasionally. When capsized and subsequently righted, water occasionally may flow through the exhaust system and into the engine, possibly causing serious damage to important engine and exhaust system components.

SUMMARY OF THE INVENTION

Accordingly, a need exists for a watercraft exhaust system that discharges exhaust gases at, below or close to the water level at which the watercraft is operating and which prevents invasion of water into the engine through the exhaust system.

In accordance with one aspect, a watercraft is provided that has a hull defining an engine compartment. An internal combustion engine is located within the engine compartment and has an output shaft. A propulsion device is carried by the hull and is connected to the engine output shaft. An exhaust system delivers exhaust gases from the engine to the environment. The exhaust system includes an exhaust expansion chamber, a connecting pipe communicating with the expansion chamber, and a water trap device communicating with the connecting pipe. The water trap device has a discharge tube formed in an upper portion thereof. A downstream end of the connecting pipe opens within a rearward portion of the water trap so that the connecting pipe downstream end is positioned outwardly from a center line of the watercraft relative to the discharge tube.

Further aspects, features, and advantages of the present invention will become apparent from the detailed description of the preferred embodiment which follows.

BRIEF DESCRIPTION OF THE DRAWINGS

The above-mentioned and other features of the invention will now be described with reference to the drawings of a preferred embodiment of the present watercraft. The illustrated embodiment of the watercraft is intended to illustrate, but not to limit the invention. The drawings contain the following figures.

DETAILED DESCRIPTION OF THE PREFERRED EMBODIMENT

Figure 1:
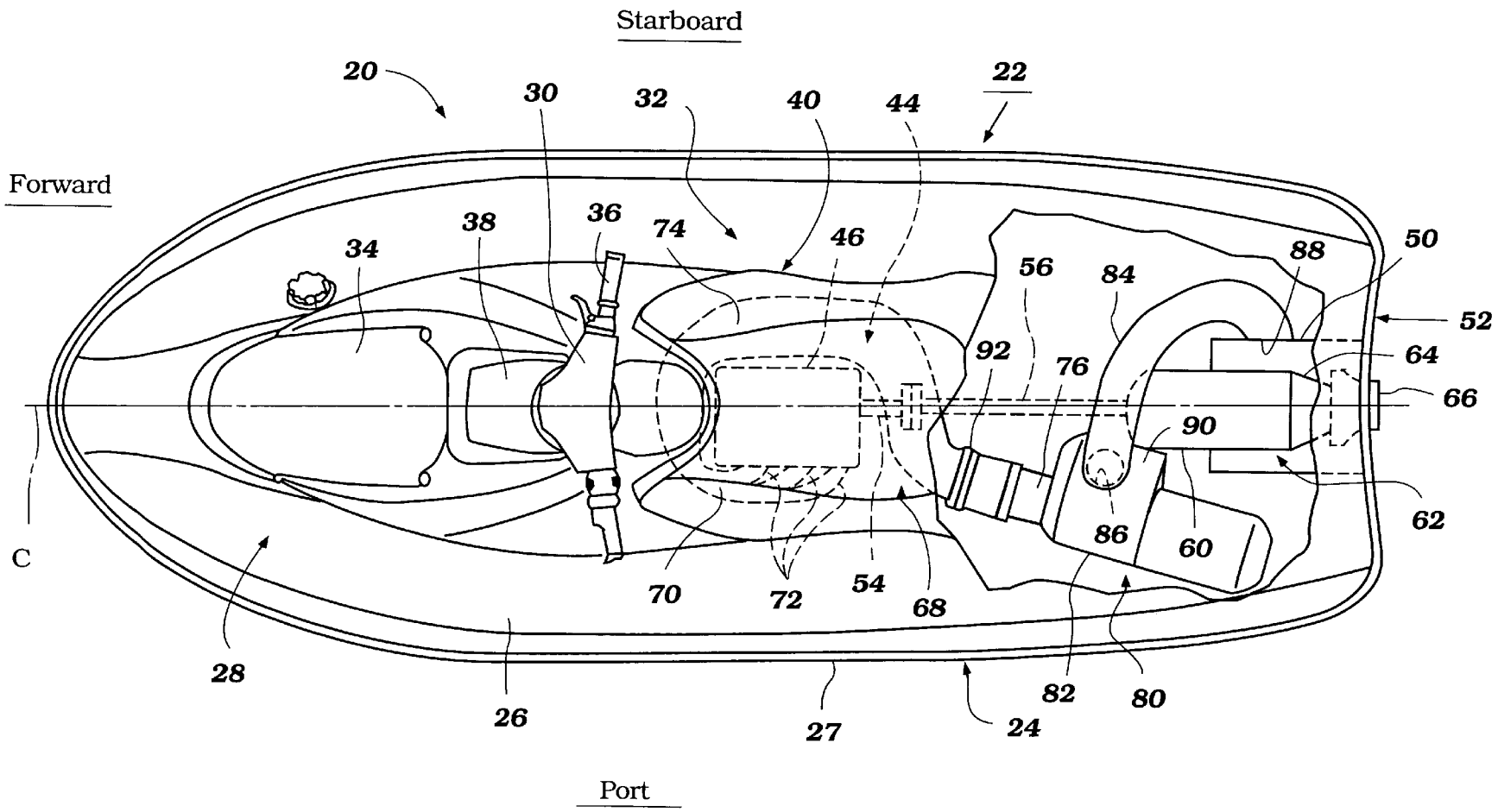
FIG. 1 is a top plan view of a personal watercraft configured in accordance with a preferred embodiment of the present invention, shown partially cut away and showing some components in phantom.

FIG. 1 shows a top view of a personal watercraft 20 that includes an exhaust system configured in accordance with a preferred embodiment of the present invention. Although these features are illustrated in connection with a personal watercraft, they can be used with other types of watercraft as well, such as, for example, but without limitation, small jet boats and the like.

The following describes the illustrated watercraft in reference to a coordinate system in order to case the description of the watercraft. A longitudinal axis extends from bow to stem and a lateral axis extends from port side to starboard side normal to the longitudinal axis. In addition, relative heights are expressed in reference to the undersurface of the watercraft. In FIG. 1, a label "forward" has been included for reference purposes.

With initial reference to FIG. 1, the watercraft 10 includes a body 22 formed by a lower hull 24 and a deck 26. The hull 24 and the deck 26 are formed from a suitable material such as, for example, a molded fiberglass reinforced resin or SMC. The hull 24 and the deck 26 are fixed to each other around the peripheral edges 27 in any suitable manner.

The hull 24 is designed in a manner conventional in the art so that the watercraft 10 planes or rides on a decreased surface area at the aft end of the hull 24 in order to optimize the speed and handling of the watercraft 20 when on plane.

With reference to FIG. 1, the deck 26 includes a bow portion 28, a control mast 30 and a rider's area 32, as viewed in the direction from the bow to the stern of the watercraft 20. The bow portion 28 slopes upwardly toward the control mast 30 and includes a hatch cover 34 disposed over a front storage compartment.

The control mast 30 extends from the bow portion 28 and supports a handlebar assembly 36. The handlebar assembly 36 controls the steering of the watercraft 20 in a conventional manner. The handlebar assembly 36 also carries a variety of controls of the watercraft 20, such as, for example, a throttle control, a start switch and a lanyard switch. In the illustrated embodiment, a cowling 38 forms a portion of the control mast 30.

A display panel (not shown) desirably is located in front of the control mast 30 on the bow portion 28 and is orientated to be visible by the rider. The display panel desirably displays a number of performance characteristics of the watercraft such as, for example, watercraft speed (via a speedometer), engine speed (via a tachometer), fuel level, oil level, engine temperature, battery charge level and the like.

The rider's area 32 lies behind the control mast 30 and includes a seat assembly 40. In the illustrated embodiment, the seat assembly 40 has a longitudinally extending straddle-type shape that may be straddled by an operator and by at least one, two or three passengers.

The hull forms an engine compartment 44 that is located primarily below the seat 40 and encloses an internal combustion engine 46, which supplies propulsive force to the watercraft 20. In the illustrated embodiment, the engine 46 comprises a four cycle, three cylinder, inline engine and is disposed so that its cylinder bores are inclined slightly to one side of vertical. It is to be understood that the present exhaust system can advantageously be used with a variety of engine types having other number of cylinders, having other cylinder arrangements (e.g., parallel to the vertical central plane) and operating on other combustion principles (e.g., two-stroke principle).

A recessed channel or tunnel 50 is formed toward an aft end of the hull 24 and opens through the rear of the watercraft. The engine 46 drives an output shaft 54 which is coupled to an impeller shaft 56. The impeller shaft 56 drives an impeller within an impeller housing assembly 60 of a jet propulsion unit 62, which is mounted within the tunnel 50. The impeller housing assembly 60 also acts as a pressurization chamber and delivers the water flow from the impeller housing to a discharge nozzle 64. In the illustrated embodiment, the impeller shaft 56 lies generally along a center line C of the watercraft 20.

A steering nozzle 66 is supported at the downstream end of the discharge nozzle 64 by a pair of vertically extending pivot pins. In an exemplary embodiment, the steering nozzle 66 has an integral lever on one side that is coupled to the handlebar assembly 30 through, for example, a bowden-wire actuator, as known in the art. In this manner, the operator of the watercraft 20 can move the steering nozzle 66 to effect directional changes of the watercraft 20.

An exhaust system 68 discharges exhaust byproducts from the engine 46 to the atmosphere and/or to the body of water in which the watercraft 20 is operated. The exhaust system 68 includes an exhaust manifold 70 that is affixed to the side of the engine cylinder block and which receives exhaust gases from the combustion chambers through exhaust ports in a well-known manner. For this purpose, the exhaust manifold 70 desirably includes a number of runners 72 equal in number to the number of cylinders. Each runner communicates with the exhaust port(s) of the respective cylinder. The runners of the exhaust manifold thence merge together at a merge point to form a common exhaust path that terminates at an outlet end of the manifold 70.

An outlet end of the exhaust manifold communicates with an exhaust expansion chamber 74. The outlet end of the manifold 70 turns upward to mate with a down-turned inlet end of the expansion chamber 74.

The expansion chamber 74 wraps around the front side of the engine 46 and extends along an opposite side of the engine 46 to a point just beyond the rear side of the engine 46. The expansion chamber 74 then turns downward and communicates with a connection pipe 76. In the illustrated embodiment, the connection pipe 76 comprises a substantially straight tube. It is to be understood that the connection pipe can comprise various shapes and arrangements such as, for instance, comprising a convergent cone and a stinger.

The connection pipe 76 communicates with a water trap 80. The water trap 50 includes a generally cylindrical main body 82 that is coupled to the hull 24 by suitable means. For example, one or more elastic straps, which are secured to the lower hull portion 24 by bolts, hold the water trap body to the hull.

The water trap device 80 has a fairly large volume and is designed so as to trap water to prevent it from flowing through the exhaust system 68 to the expansion chamber 74 and the engine 46. A drain (not shown) can be provided to facilitate removal of water accumulated within the trap 80. Additional structural features and advantages of the illustrated water trap device are discussed below.

An exhaust discharge conduit 84 is connected to a discharge outlet tube 86 of the water trap device 80 and wraps over the top of the tunnel 50 to an exhaust discharge end 88. The discharge end 88 opens into the tunnel 50 in the illustrated embodiment at an area that is close to or actually below the water level L when the watercraft 20 is floating at rest on the body of water. It is to be understood that the discharge end 88 can open through the transom 52 of the watercraft 20, if desired. The discharge conduit is preferably a flexible hose; however, any suitable rigid or flexible conduit can be used.

Figure 2:
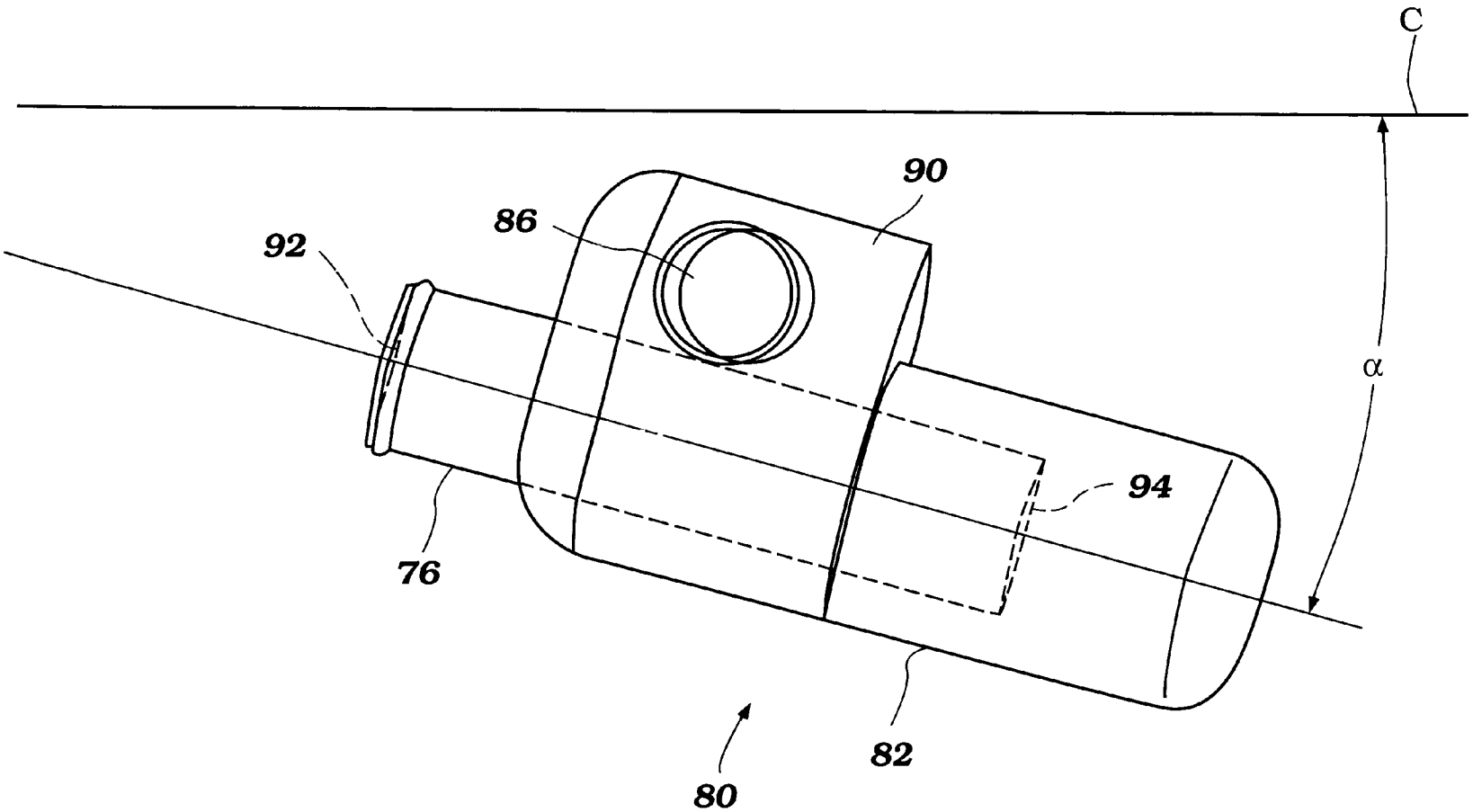
FIG. 2 is a top plan view of the water trap of the personal watercraft of FIG. 1.

With reference also to FIG. 2, the illustrated water trap 80 is positioned toward the port side of the watercraft center line C and is disposed at an angle $\alpha$ relative to the center line. The angle $\alpha$ is preferably between about 0–45°. More preferably the angle $\alpha$ is between about 10°–30°, and most preferably the angle $\alpha$ from the center line C is about 15°.

The water trap 80 is preferably generally cylindrical, except that an enlarged portion 90 is formed toward the forward side of the water trap 80. The enlarged portion 90 preferably is also generally cylindrical but is not concentric with the rest of the water trap. Also, the enlarged portion 90 is preferably off set from the main body 82 of the water trap 80 and extends from the main body 82 towards the impeller shaft 56. In the illustrated arrangement, the main body 82 is disposed laterally outward relative to the enlarged portion 90 for reasons that will become apparent. The discharge outlet tube 86 extends upwardly from an upper portion of the enlarged portion 90 and is oriented on a side of the enlarged portion toward the impeller shaft 56.

Since the tunnel 50 extends into the hull 24 toward the rear end of the watercraft 20, the water trap 80 is both sized and positioned so that its inward-most side is positioned far enough from the watercraft center line C so as to leave room for the tunnel 50. For example, in the illustrated embodiment, the enlarged portion 90 fits generally adjacent the impeller housing assembly 60 at a point forward of the tunnel 50 and the rest of the main body 82 is positioned laterally farther outward from the center line C and generally adjacent the tunnel 50.

With reference to FIG. 1, an upstream end 92 of the connection pipe 76 communicates with the downstream end of the expansion chamber 74. The connection pipe 76 extends into the water trap 80 and a downstream outlet 94 (see FIG. 2) of the pipe 76 opens within the water trap 80 at a point rearward of the enlarged portion 90 and discharge outlet tube 86 so that the connection pipe outlet 94 is positioned laterally farther outward from the center line C than the discharge outlet tube 86.

Figure 3:
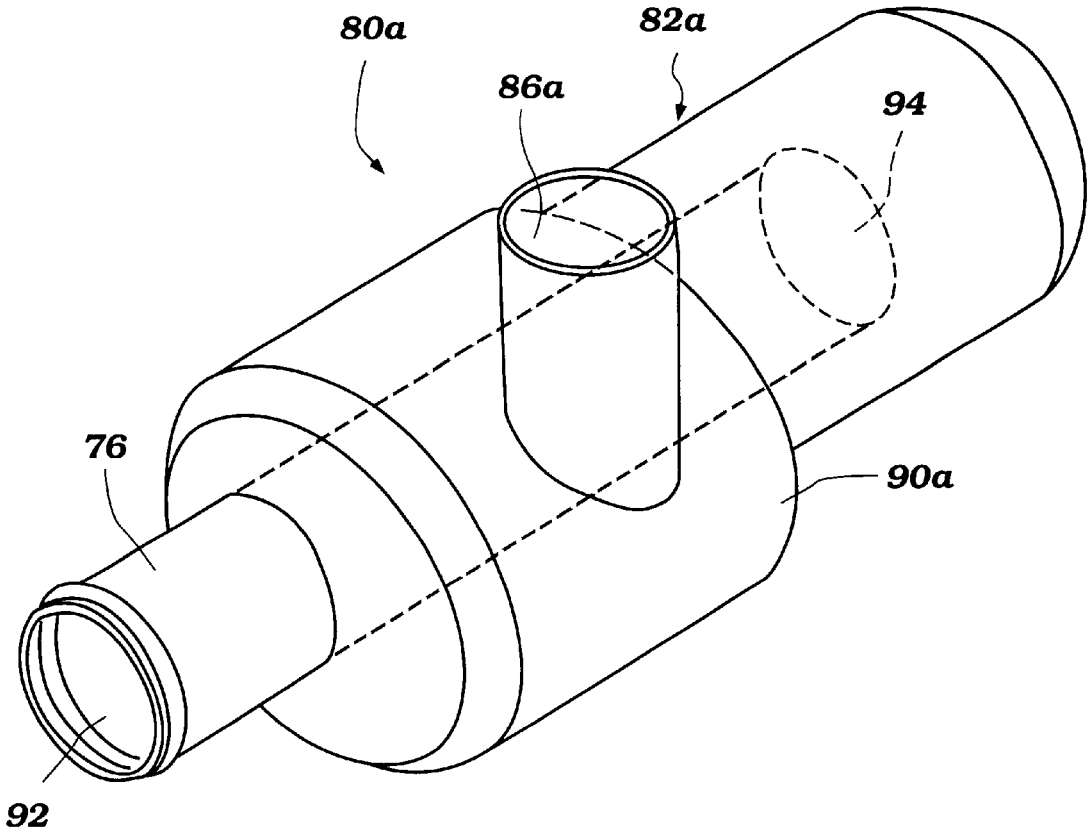
FIG. 3 is a perspective view of another embodiment of a water trap configured in accordance with a preferred embodiment of the present invention.

Although the present embodiment illustrates the water trap angled toward the port side of the watercraft, it is to be understood that the water trap could also be angled toward the starboard side of the watercraft. FIG. 3 illustrates a perspective view of an embodiment of a water trap 80*a* for positioning within a starboard side of the watercraft.

Due to the extreme nature of some of the maneuvers performed by riders of personal watercraft, it is expected that the watercraft will, on occasion, become capsized.

To return the watercraft 20 to the upright position, the watercraft 20 is rolled about its center line C with either the starboard or port sides of the watercraft becoming submerged during the roll.

Figure 4:
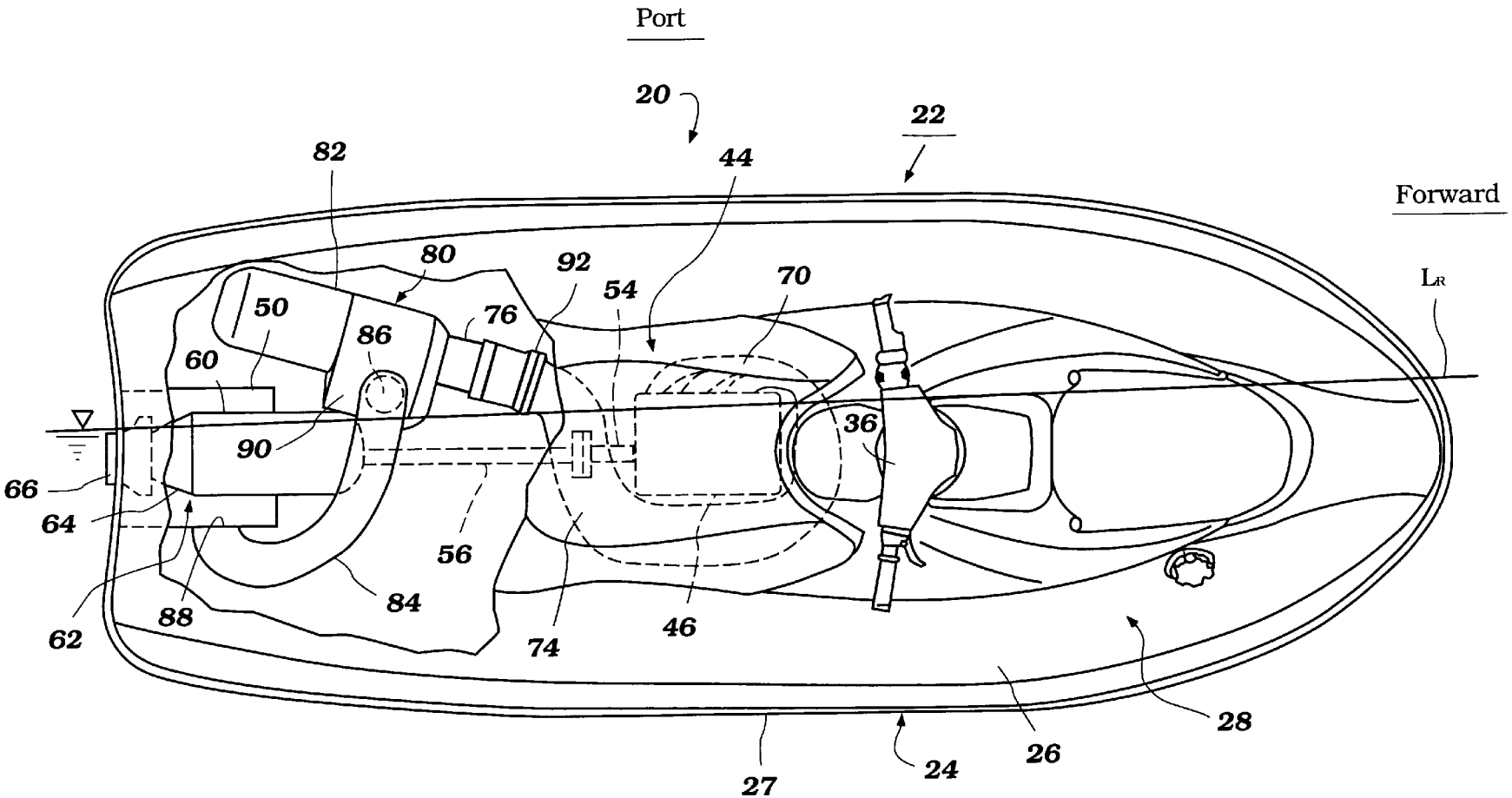
FIG. 4 shows the watercraft of FIG. 1 rolled to its starboard side in the body of water in which it is operating.

FIG. 4 shows the watercraft 20 of FIG. 1 rolled onto its starboard side. The starboard side of the watercraft is completely submerged below a water level $L_R$ of the body of water in which the watercraft 20 is being operated. In this condition, water will rush into the discharge conduit 84 and may flow into the water trap 80. Advantageously, water entering the water trap 80 will be caught in the enlarged portion 90.

Figure 5:
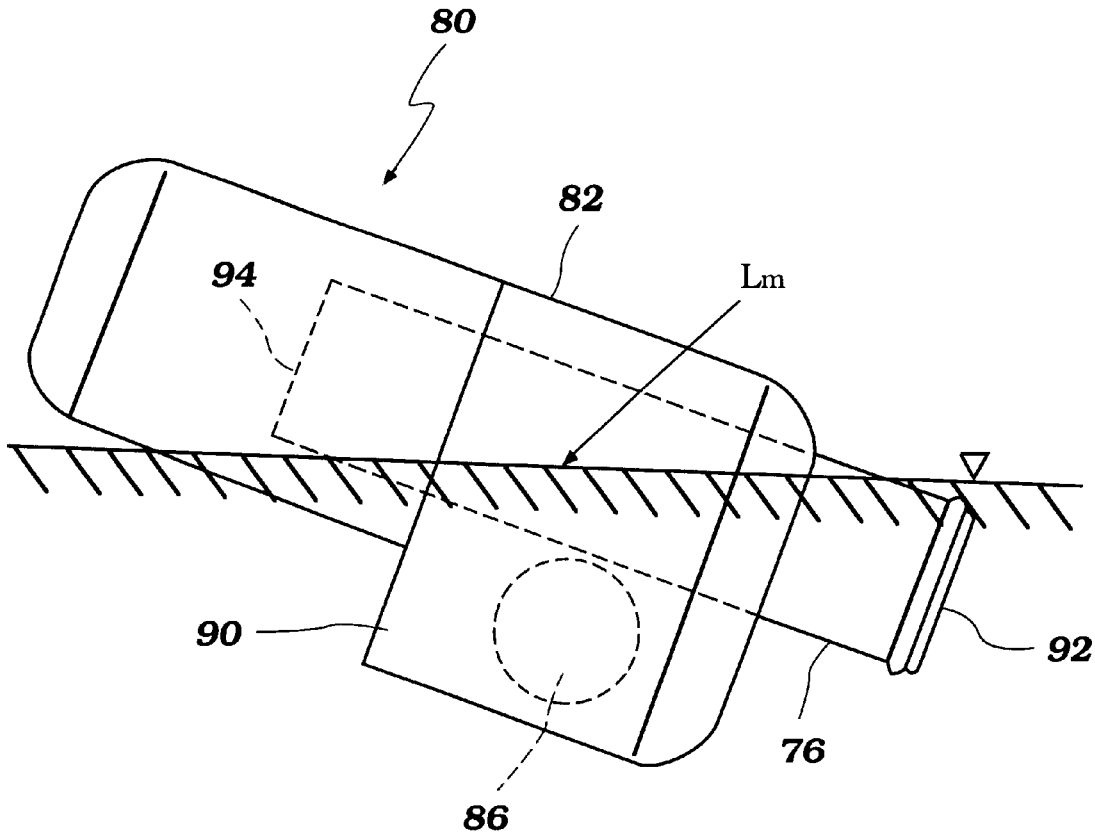
FIG. 5 shows the water trap of FIG. 2 within the watercraft of FIG. 4, and shows a higher water level relative to the water trap.

With reference also to FIG. 5, the structure and positioning of the water trap 80 precludes water from entering the connection pipe discharge outlet 94. Because the connector pipe discharge outlet 94 opens toward the rear of the water trap 80 and is offset outwardly from the center line C relative to the discharge outlet tube 86, water within the water trap 80 collects below the connection pipe outlet 94, and is thus prevented from flowing into the outlet 94, from where it could flow into the expansion chamber 74 and the engine 46.

FIG. 5 depicts a higher water level $L_M$. At water levels much higher than this level, water may flow into the connection pipe discharge outlet 94. As can be seen, this higher water level $L_M$ is well above the water level $L_R$ anticipated during rollover, as shown in FIG. 4. Advantageously, the sizing and positioning of the components, combined with the degree of buoyancy of the watercraft, result in the actual water level experienced under more adverse than normal operation being lower than the water level $L_M$.

Figure 6:
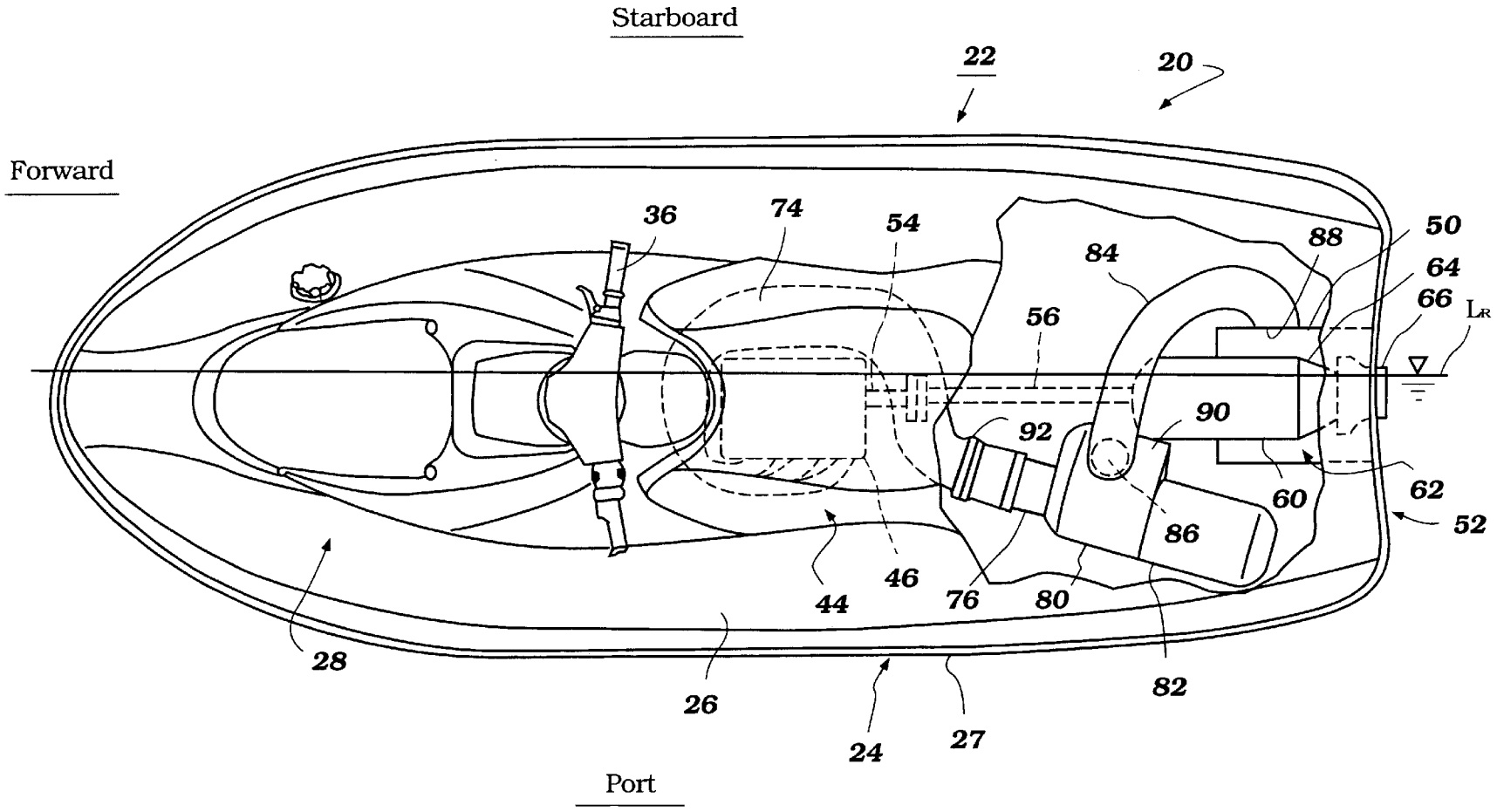
FIG. 6 shows the watercraft of FIG. 1 rolled to its port side in the body of water in which it is operating.

As discussed above, the watercraft can also be righted by rolling the watercraft so that the port side is submerged during the roll. With next reference to FIG. 6, when the port side is submerged, the outlet of the discharge conduit is above the water surface.

Additionally, a portion of the discharge conduit 84 extends further toward the starboard side, which further protects against water flowing into the water trap 80. Accordingly, water generally does not flow into the discharge conduit and to the water trap.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A watercraft comprising a hull defining an engine compartment, an internal combustion engine located within the engine compartment and having an output shaft, a propulsion device carried by the hull and connected to the engine output shaft, and an exhaust system for delivering exhaust gases from the engine to the environment, the exhaust system comprising an expansion chamber, a connection pipe communicating with the expansion chamber, and a water trap device communicating with the connection pipe, the water trap device having a main body having a forward portion and a rearward portion, an enlarged portion being formed in the forward portion of the main body, and a discharge port being formed in an upper portion of the enlarged portion, and a downstream end of the connection pipe opening within the rearward portion of the main body, the connection pipe downstream end positioned farther outwardly from a center line of the watercraft than the discharge port.

2. A watercraft as in claim 1, wherein the water trap is positioned in a manner so that a longitudinal axis of the water trap device is angled relative to the center line of the watercraft.

3. A watercraft as in claim 2, wherein the angle is less than about 45°.

4. A watercraft as in claim 3, wherein the angle is between about 10° and about 30°.

5. A watercraft as in claim 4, wherein the angle is about 15°.

6. A watercraft as in claim 2, wherein a discharge conduit is connected to the discharge port and extends across the center line to an exhaust discharge outlet formed through the hull of the watercraft.

7. A watercraft as in claim 6, wherein the enlarged portion has an axis, and the enlarged portion axis is offset from the water trap longitudinal axis.

8. A watercraft as in claim 7, wherein the enlarged portion axis is closer to the propulsion device than the water trap longitudinal axis.

9. A watercraft as in claim 6, wherein the discharge port is formed generally toward a side of the enlarged portion closest to the watercraft center line.

10. A watercraft comprising a hull defining an engine compartment, an internal combustion engine located within the engine compartment and having an output shaft, a propulsion device carried by the hull and connected to the engine output shaft, and an exhaust system for delivering exhaust gases from the engine to the environment, the exhaust system comprising an exhaust expansion chamber, a connecting pipe communicating with the expansion chamber, and a water trap device communicating with the connecting pipe, the water trap device having a discharge tube formed in an upper portion thereof, and a downstream end of the connecting pipe opens within a rearward portion of the water trap so that the connecting pipe downstream end is positioned outwardly from a center line of the watercraft relative to the discharge tube.

11. A watercraft as in claim 10, wherein the water trap device is positioned generally on a first side of the watercraft center line.

12. A watercraft as in claim 11, wherein the water trap is positioned generally on a port side of the watercraft center line.

13. A watercraft as in claim 11, wherein the water trap has a longitudinal axis, and the axis is angled relative to the watercraft center line.

14. A watercraft as in claim 13, wherein the angle is between about 10° and about 30°.

15. A watercraft as in claim 14, wherein the angle is about 15°.

16. A watercraft as in claim 11, wherein the connecting pipe end is positioned generally rearward of the discharge tube.

17. A watercraft as in claim 16, wherein the connecting pipe is substantially straight.

18. A watercraft as in claim 16, wherein the water trap device has an expanded portion formed toward a forward end of the water trap, the expanded portion being generally larger than the rest of the water trap.

19. A watercraft as in claim 18, wherein the discharge port is formed in the expanded portion, and the discharge tube is generally on a side of the water trap closest to the watercraft center line.

20. A watercraft as in claim 16, wherein the discharge tube communicates with a discharge conduit, and the discharge conduit extends to an exhaust discharge port formed through the hull, the exhaust discharge port being on a side of the watercraft center line opposite the water trap.

21. A watercraft as in claim 20, wherein the exhaust discharge port is positioned so that exhaust is discharged at or below water level when the watercraft is at rest.

22. A watercraft as in claim 20, wherein the exhaust discharge port is positioned adjacent the propulsion unit.

23. A watercraft comprising a hull defining an engine compartment, an internal combustion engine located within the engine compartment and having an output shaft, a propulsion device carried by the hull and connected to the engine output shaft, and an exhaust system for delivering exhaust gases from the engine to the environment, the exhaust system comprising a exhaust pipe and a water trap device communicating with the exhaust pipe, the water trap device having a discharge port communicating with a discharge tube, and a downstream end of the exhaust pipe opens within a rearward portion of the water trap so that the exhausted pipe downstream end is positioned outwardly from a center line of the watercraft relative to the discharge port.

24. A watercraft as in claim 23, wherein the water trap device is positioned generally on a first side of the watercraft center line.

25. A watercraft as in claim 24, wherein the water trap is positioned generally on a port side of the watercraft center line.

26. A watercraft as in claim 24, wherein the water trap has a longitudinal axis, and the axis is angled relative to the watercraft center line.

27. A watercraft as in claim 26, wherein the angle is between about 10° and about 30°.

28. A watercraft as in claim 27, wherein the angle is about 15°.

29. A watercraft as in claim 24, wherein the connecting pipe end is positioned generally rearward of the discharge port.

30. A watercraft as in claim 29, wherein the water trap device has an expanded portion formed toward a forward end of the water trap, the expanded portion being generally larger than the rest of the water trap.

31. A watercraft as in claim 30, wherein the discharge port is formed in the expanded portion, and the discharge tube is generally on a side of the water trap closest to the watercraft center line.

32. A watercraft as in claim 29, wherein the discharge tube communicates with a discharge conduit, and the discharge conduit extends to an exhaust discharge port formed through the hull, the exhaust discharge port being on a side of the watercraft center line opposite the water trap.

33. A watercraft as in claim 32, wherein the exhaust discharge port is positioned so that exhaust is discharged at or below water level when the watercraft is at rest.

34. A watercraft as in claim 32, wherein the exhaust discharge port is positioned adjacent the propulsion unit.

* * * * *

UNITED STATES PATENT AND TRADEMARK OFFICE

CERTIFICATE OF CORRECTION

PATENT NO. : 6,554,665 B1
DATED : April 29, 2003
INVENTOR(S) : Yoshiyuki Kaneko

It is certified that error appears in the above-identified patent and that said Letters Patent is hereby corrected as shown below:

Title page,
Item [56], References Cited, U.S. PATENT DOCUMENTS, the following references are added:

-- 4,019,456 A 4/1977 Harbert
5,550,337 A 8/1996 Tazaki et al.
6,019,648 A 2/2000 Lecours et al. --

Signed and Sealed this

Fifteenth Day of July, 2003

JAMES E. ROGAN
*Director of the United States Patent and Trademark Office*